United States Patent [19]

Faure et al.

[11] Patent Number: 4,581,559

[45] Date of Patent: Apr. 8, 1986

[54] DEVICE FOR RAPIDLY DISCHARGING WITHOUT ARCING A HIGH-VOLTAGE SOURCE

[75] Inventors: Laurent Faure, Saint Egreve; Roger Tholomé, La Tronche, both of France

[73] Assignee: Sames S.A., Meylan, France

[21] Appl. No.: 646,446

[22] Filed: Aug. 31, 1984

[51] Int. Cl.[4] ..... H01J 1/02; B05B 5/00

[52] U.S. Cl. ..... 313/147; 239/691

[58] Field of Search ..... 313/146, 147; 361/222; 200/144 AP; 239/691, 700–703, 707; 118/629; 315/330, 331

[56] References Cited

U.S. PATENT DOCUMENTS

| | | | |
|---|---|---|---|
| 2,959,353 | 11/1960 | Croskey et al. | 239/15 |
| 3,935,508 | 1/1976 | Moister, Jr. | 361/222 |
| 4,244,527 | 1/1981 | DeFusco | 239/691 |

FOREIGN PATENT DOCUMENTS

| | | |
|---|---|---|
| 1137824 | 6/1957 | France . |
| 2274155 | 1/1976 | France . |

*Primary Examiner*—Palmer C. DeMeo
*Assistant Examiner*—Sandra L. O'Shea
*Attorney, Agent, or Firm*—Young & Thompson

[57] ABSTRACT

A device for rapidly discharging without arcing a high-tension DC voltage source includes a cylinder of an insulative material in which slide two electrode pistons. These are equipped with internal auxiliary pistons which carry needles which can be deployed so as to project beyond the domed ends of the electrode pistons. The electrode pistons are connected to the terminals of the high-tension voltage source. When compressed air is fed into the central part of the cylinder, the electrode pistons and the auxiliary pistons are driven towards the ends of the cylinder. The rounded domes and the increased pressure of the air provide a high degree of insulation. Once the high-tension DC voltage source has been switched off, the center of the cylinder is vented to atmosphere. The auxiliary pistons are driven towards one another by springs, entraining the electrode pistons and deploying the needles. A corona discharge is established and this discharges the capacitance of the source before the needles come into contact with one another.

8 Claims, 5 Drawing Figures

DEVICE FOR RAPIDLY DISCHARGING WITHOUT ARCING A HIGH-VOLTAGE SOURCE

BACKGROUND OF THE INVENTION

1. Field of the Invention

The invention concerns a device for rapidly discharging without arcing a high-tension DC voltage source which has a very high capacitance when coupled to the impedance of a load circuit, the device comprising two electrodes connected to respective poles of the source which are moved towards one another by triggering means until they come into contact with one another.

The present invention was developed in the context of electrostatic spraying, in which a jet of atomized material is projected onto a part to be coated, the jet being electrostatically charged to several tens of kilovolts.

2. Description of the Prior Art

For obvious safety reasons, the electrodes which charge the jet must be discharged after the sprayer is shut down without any arc being struck, since the atomized material is generally also inflammable, containing organic solvents.

Various methods are known for discharging the source: a corona discharge from the high-tension electrodes themselves, or by short-circuiting the terminals of the source or through a resistance permanently connected to the source.

U.S. Pat. No. 2,959,353 describes a circuit-breaker device for short-circuit discharging the capacitance of a coaxial cable connecting a high-tension source of approximately 40 kV to the electrode for charging the jet from an electrostatic spray gun. The circuit-breaker comprises a pneumatic actuator with a piston which moves in a cylinder between two positions, entraining an axial rod. In a first position one end of the rod is in abutment contact with a ground contact; in the second position the other end of the rod is in abutment contact with an output terminal of the high-tension source. The cylinder, piston and rod are connected to the core of the coaxial cable connected to the charging electrode. Operation of the piston is conditioned by operation of the gun so that the sprayed jet is charged and the capacitance of the cable is discharged to ground when spraying is stopped. The energy of the charge on the cable, which is between approximately 0.01 and 0.1 joules, is suddenly dissipated, at the time of the discharge, in a high-energy spark.

In certain cases the jet of atomized material is charged by means of corona discharges produced by needle-shaped charging electrodes. Typically a needle 10 mm long with a diameter of a few tenths of a millimeter emits towards a flat conductor (ground plane) 10 cm away a current of approximately 60 $\mu$A when the potential difference between the needle and the plane is 60 kV. This corresponds to an apparent resistance of 1 Gohm. If the needle is brought progressively closer to the ground plane during the discharge, the apparent resistance of the discharge remains approximately the same.

The self-capacitance of the needle relative to the conductive ground plane when 10 cm away is approximately 1 pF, defining a time constant of the order of 1 ms; this should be highly acceptable.

However, when as in the device described in U.S. Pat. No. 2,959,353 the capacitance to be discharged is significantly higher, of the order of 100 pF, for example, the discharge time increases proportionately. Also, where the charging electrode does not produce a corona discharge or ceases to do so before the capacitance is discharged, the discharge time may be as much as several seconds, which is unacceptable. And, as has already been stated, the short-circuit discharge method produces a high-energy spark.

Consideration might be given to using corona discharges to discharge without arcing the capacitance of high-tension sources. There is known, for example, from U.S. Pat. No. 3,935,508 an apparatus capable of discharging the static electricity accumulated in the body of an operator in a dry atmosphere, due to rubbing against highly insulative surfaces, without the operator experiencing any disagreeable shock and without any spark being produced to generate interference likely to disturb the operation of delicate electronic equipment. The device essentially comprises, in a bellows-shaped insulating body, a sharp point linked to a conductive contact at the top of the bellows, on which the finger of the operator presses, and facing this a plate connected to ground through a resistance. When the operator places his finger on the contact, a corona discharge is produced at the tip of the sharp point and discharges the capacitance formed by the body of the operator. Deformation of the bellows moves the point towards the plate, so that the discharge is maintained until the operator is fully discharged, with the point touching the plate. The resistance through which the plate is grounded is selected such that the discharge does not degenerate into a spark.

If operation of this device is analyzed, it is seen that it is not able to overcome the problem of discharging without sparking the capacitance of a high-tension source.

At a given voltage, the electric field in the vicinity of a point is not inversely proportional to the distance which separates the point from an oppositely charged surface. For a point not to produce corona discharges at the voltages currently used for electrostatic spraying, it would be necessary for the travel of the point to discharge the capacitance of the high-tension source to be prohibitive.

Note also that this question does not arise in the application which is the subject of the U.S. patent, since to the insulation between the point and plate there is added, when discharging is not required, the de facto insulation between the finger of the operator and the contact connected to the point. Furthermore, in the application to which the U.S. patent relates, it would be advantageous for a discharge to occur as soon as the voltage of the operator relative to ground attained a value causing problems.

SUMMARY OF THE INVENTION

The invention consists of a device for rapidly discharging without arcing a high-tension DC voltage source which has a very high capacitance when coupled to the impedance of a load circuit, comprising two dome-shaped electrodes adapted to be connected to respective poles of said source, trigger means adapted to move said electrodes towards one another along a predetermined path on which the domes are centered and until they come into contact with one another, a deployable needle on at least one of said electrodes adapted to be deployed beyond the boundary of the aforementioned dome shape thereof in the direction of movement of said at least one electrode when said electrodes are moved towards one another, and means for containing an insulative gas around said electrodes, whereby a discharge from said needle or needles into said gas removes a substantial proportion of the electrical charge stored in the aforementioned capacitance before the aforementioned contact takes place.

Although the general dome shape of the electrodes makes it possible to dispose them in the insulative gas at a sufficiently small distance from one another for their trajectory until contact occurs to be travelled rapidly without discharges occurring from the electrodes into the gas, the projection of the deployable needle during their relative movement towards one another favors discharge emission with sufficient current. The time constant for discharging the source may thus be made sufficiently short. The reduction in the distance between the electrodes in the ready position, as authorized by their shape, is favorable to effective confinement of these electrodes in the insulative gas.

For preference, each of the electrodes comprises a respective deployable needle and is controlled by a piston, the device further comprising a common insulative cylinder in which each of the pistons is adapted to slide and a pipe which is adapted to be selectively connected to a supply of pressurized gas or vented to atmosphere by the trigger means and which communicates with the cylinder in its median part, between the pistons, whereby the pistons are held apart and the needles are retracted against return means by gas pressure when the pipe is connected to the pressurized gas supply.

Using this arrangement the electrodes are held apart by the pressurized gas. As the breakdown field strength in the gas is proportional to its pressure, adequate isolation is obtained between the live electrodes in spite of the relatively small distance between them. The venting to atmosphere of the pipe supplying the pressurized gas not only deploys the needles and starts the electrodes moving towards one another, but also reduces the pressure of the gas between the electrodes, which favors the onset of discharge.

For preference, the aforementioned electrode pistons comprise internal auxiliary pistons attached to the needles and on which the return means act, and vents are provided in the electrode pistons and the auxiliary pistons to provide for adjustment of the pressure between the electrode pistons and auxiliary pistons and the relative displacement thereof, and to provide for the circulation of the pressurized gas in order to avoid ions accumulating in the space between the electrodes.

The return means may comprise metal springs disposed in compression between the auxiliary pistons and respective ends of the cylinder, each of which ends is formed with a vent, the device further comprising respective connections passing through the ends of the cylinder and adapted to connect the springs to respective poles of the source. They may also be implemented by pressurizing the spaces between the ends of the cylinder and the auxiliary pistons by means of a trigger device consisting of a four-way valve. Variations in pressure behind the auxiliary pistons provide for the deployment and retraction of the needles.

In a preferred embodiment the needles have ends of complementary shape, one having a point and the other a sharp-edged conical recess. In this way good contact may be obtained between the needles without deterioration of their ends.

Other objects and advantages will appear from the following description of examples of the invention, when considered in connection with the accompanying drawings, and the novel features will be particularly pointed out in the appended claims.

DESCRIPTION OF THE PREFERRED EMBODIMENTS

Figure 1:
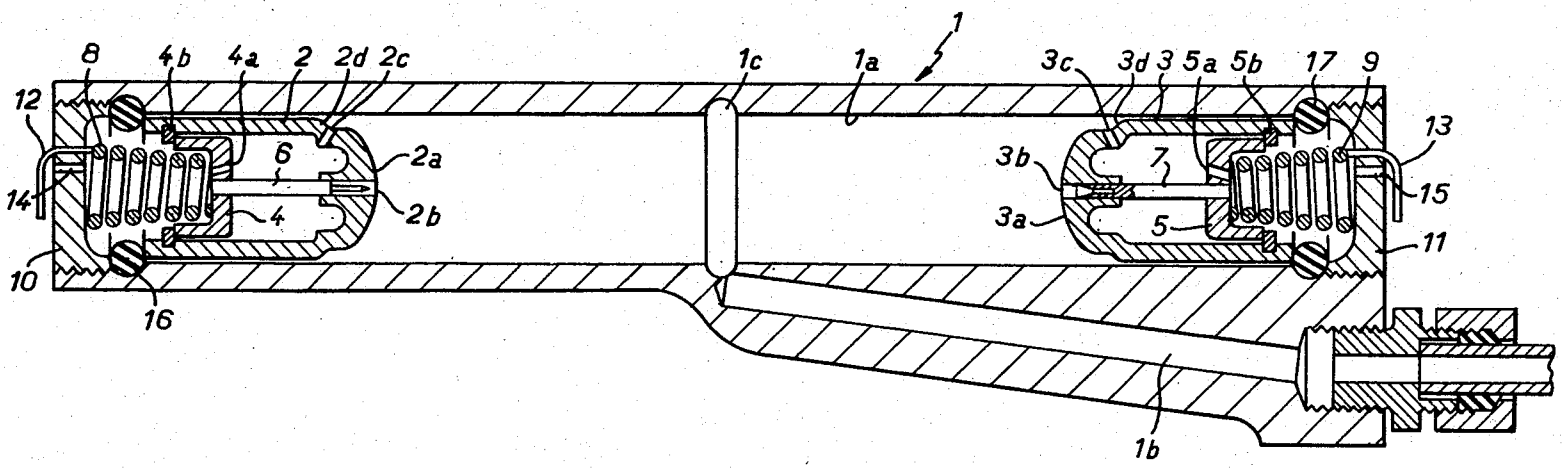
FIG. 1 shows a device in accordance with the invention in the ready position, in axial cross-section.
Figure 2:
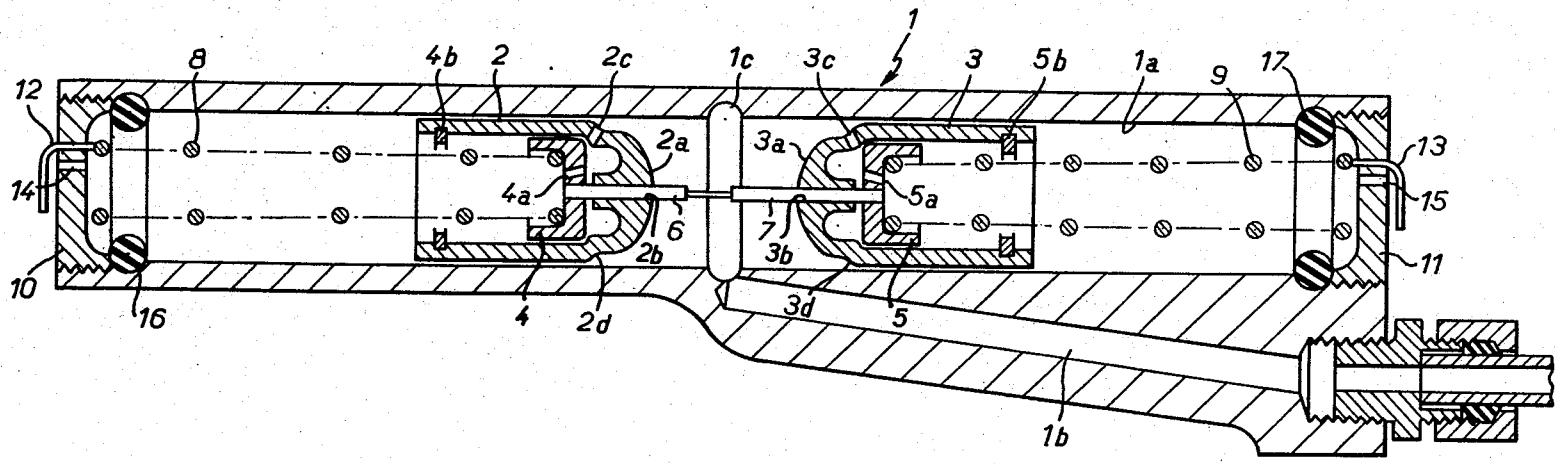
FIG. 2 shows the device from FIG. 1 in the short-circuit position.

In the embodiment shown in FIGS. 1 and 2, the device comprises a cylindrical body 1 of an insulative material with end members 10 and 11 at its ends. The inside surface 1*a* of the cylinder 1 is precision machined and comprises in its median part a groove 1*c* into which opens an oblique channel 1*b* which may be connected to a source of compressed air.

In the cylinder 1 are disposed two metal pistons 2 and 3, the respective facing ends 2*a* and 3*a* of which are of part-spherical domed shape, their diameter at the base being less than that of the surface 1*a* of the cylinder 1. These domes 2*a*, 3*a* merge with the lateral surface of the pistons 2, 3 via rounded shoulders 2*d*, 3*d*. Toroidal rings 16, 17 inserted in grooves formed in the surface 1*a* in the vicinity of the end members 10, 11 constitute respective rear abutment members for the travel of the pistons 2, 3.

The pistons 2, 3 are fitted internally with respective metal auxiliary pistons 4, 5 which are coaxial with them and rearward movement of which is limited by rings 4*b*, 5*b* accommodated inside the skirts of the pistons 2, 3. The auxiliary pistons 4, 5 carry at the center of their front surface respective needles 6, 7 which are inserted in holes 2*b*, 3*b* formed on the axis of the domes 2*a*, 3*a*, the points of these needles 6, 7 being retracted within the domes 2*a*, 3*a* when the auxiliary pistons 4, 5 are in the rear abutment position against the abutment rings 4*b*, 5*b*. Metal springs 8, 9 are disposed between the end members 10, 11 and the rear surface of the respective auxiliary pistons 4, 5, these springs 8, 9 being able to expand until the ends of the needles 6, 7 are placed in contact with one another, as shown in FIG. 2.

The springs 8, 9 make contact with the auxiliary pistons 4 and 5 and are connected to lead-through terminals 12 and 13 which pass through the end members 10 and 11 to permit the electrode pistons to be connected to the terminals of a high-tension voltage source (not shown).

Vents are formed as follows: 2*c*, 3*c* through the pistons 2, 3 of which the domes 2*a*, 3*a* constitute electrodes, 4*a*, 5*a* through the auxiliary pistons 4, 5, and 14, 15 through the respective end members 10, 11.

When the passage 1*b* is connected to a source of compressed air at a pressure of 3 to 6 bars, the pressure of the air forces the pistons 2 and 3 towards the end members 10, 11 of the cylinder 1 until they abut against the toroidal rings 16, 17. Also, the air passing through the vents 2*c*, 4*a*, 14 at one end and 3*c*, 5*a* and 15 at the other end expands progressively so that the pressure is stepped from atmospheric pressure outside the vents 14, 15 up to the pressure in the median area of the cylinder, inwardly of vents 2c, 3c, in the areas between the end members 10, 11 and the auxiliary pistons 4, 5 and between the auxiliary pistons 4, 5 and the electrode pistons 2, 3. In practice, the vent diameters are chosen so that no excess compressed air is consumed. In this way, provided that the pressure of the supply is maintained in the median area of the cylinder 1, not only are the pistons 2, 3 applied against the toroidal rings 16, 17, but also the auxiliary pistons 4, 5 are applied against their abutment rings 4b, 5b, the springs 8, 9 being compressed. In this way it is ensured that the space between the electrodes is adequately ventilated without excessive consumption of air.

On the other hand, when the triggering system vents to atmosphere the pipe which extends the passage 1b, the relative increase in pressure in the space between the electrode pistons 2, 3 and the auxiliary pistons is rapidly reduced, the air flowing through the vents 2c, 3c and 4a, 5a. Because of the force exerted by the springs 8, 9 on the rear of the auxiliary pistons 4, 5 the latter are pushed towards the domes 2a, 3a and the needles 6, 7 are deployed forwardly of the domes 2a, 3a. The respective combinations of the electrode pistons 2, 3 and auxiliary pistons 4, 5 are propelled towards one another as the springs 8, 9 expand, assisted by the residual pressure at the ends of the cylinder 1. The needles 7, 8 come into contact with one another as shown in FIG. 2.

Having now explained the mechanical functioning of the device, its electrical functioning will be described.

When the device is in the position shown in FIG. 1, with the median area pressurized to 3 to 6 bars, and with the electrode pistons 2, 3 in abutment contact with the toroidal rings 16, 17 and the needles 6, 7 retracted behind the front surfaces of the domes of the electrodes 2a and 3a, the application of a high voltage between the terminals 12 and 13, and consequently between the electrodes 2 and 3, results in virtually no leakage of current, given the enhanced dielectric strength of the pressurized air and the rounded shape with large radius of curvature of the electrodes, which avoids any concentration of the electrostatic field at the surface of the electrodes and consequently any discharge. As is well known, the concentration of the electrostatic field in the vicinity of projections with very small radii of curvature accelerates free electrons which results in discharge through ionization.

On the other hand, when the triggering device vents to atmosphere the pipe supplying the median area of the cylinder 1, on the one hand the pressure of the air between the electrodes 2 and 3 is reduced and on the other hand the deployable needles 6 and 7 project so that the electric field is locally concentrated in the vicinity of their tips; a relatively intense discharge occurs in the vicinity of the tips of the needles and a current passes between them. It will be understood that it is preferable for the triggering device not to operate until the power feed to HT generator has been cut off, so that the current passing between the needles 6, 7 results only from the discharging of the capacitance of the high-tension electrode. As the pressure decreases the needles move towards one another and the discharge is maintained until the needles come into contact with one another, the voltage being progressively reduced.

Figure 5:
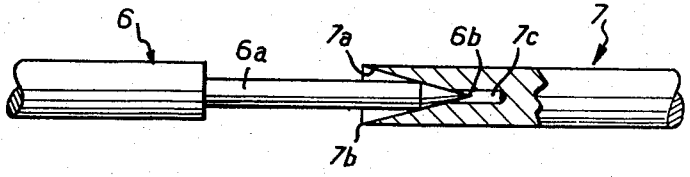
FIG. 5 shows a detail of the deployable needles.

The shape of the deployable needles 6 and 7 as shown in FIG. 5 is designed to promote efficient discharging by reducing the radii of curvature of the terminal surfaces, whilst avoiding damage to the points when firm contact is made. As can be seen, the needle 6 has a cylindrical end part 6a of reduced diameter terminated by a sharp cone 6b. The needle 7 terminates in a hollow cone 7a, with substantially the same angle at the apex as the cone 6b, merging with the cylindrical surface of the needle 7 through a sharp edge 7b. This hollow cone 7a is extended by a drilled hole 7c the diameter of which is less than the diameter of the end part 6a of the needle 6. When the needles 6 and 7 come into contact with one another the end part 6a of the needle 6 enters the hollow cone 7a, contact occurring between the flanks of the cones 6b and 7a. Thus the point of the needle 6 and the edge of the needle 7 are protected from mechanical damage.

Figure 3:
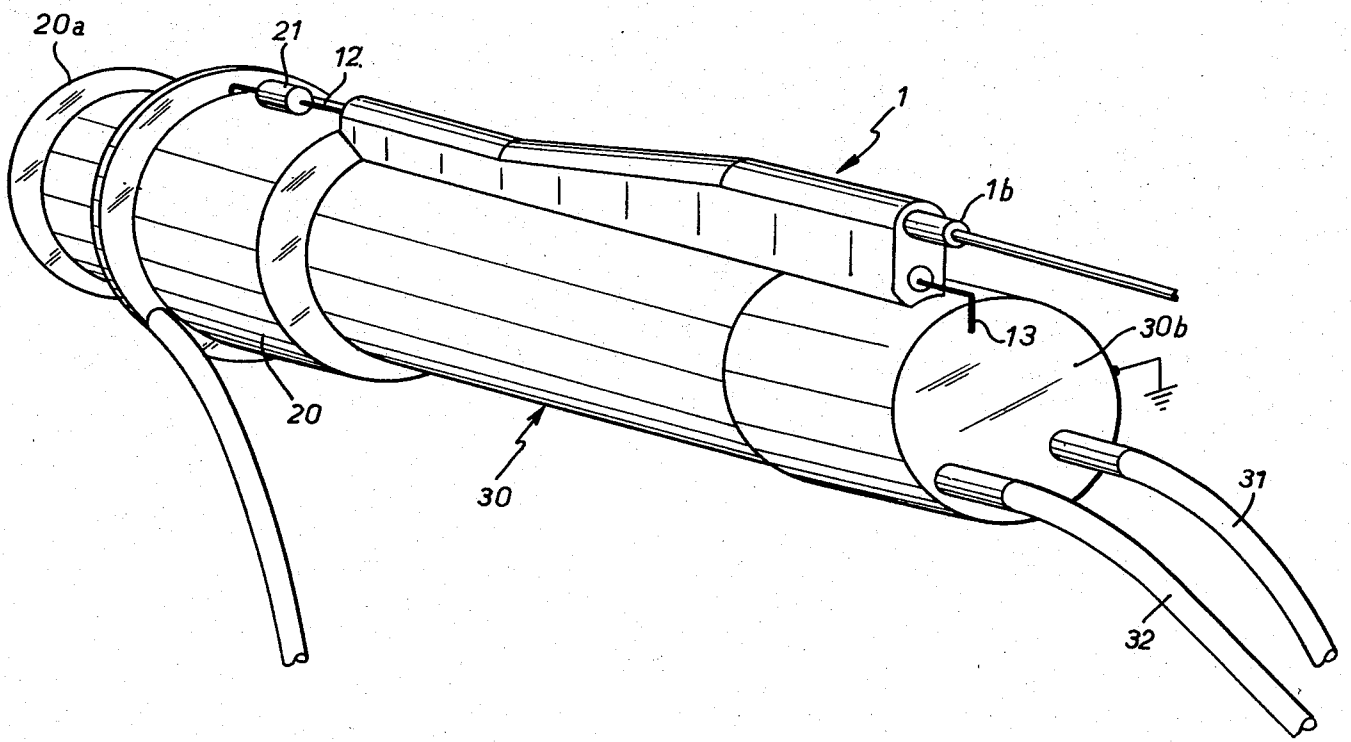
FIG. 3 is a perspective view of a rotary bowl sprayer equipped with a device in accordance with the invention.

FIG. 3 shows an electrostatic paint sprayer equipped with a dispenser unit 20a, usually referred to as a bowl, which rotates at high speed (several hundred revolutions per second). The sprayer 20 is charged to a voltage of several tens of kilovolts (typically 80 kV) by the high-tension source 30 connected to the low-tension supply by the connection 31. It has an edge which constitutes the charging electrode for a liquid which is sprayed by centrifugal force.

A fast discharge device 1 is mounted on the high-tension source 30, with the connection 12 linked to the sprayer 20 through the discharge current limiting resistor 21, whereas the connection 13 is connected to the casing 30b of the high-tension source 30, which is grounded. The fast discharge device is fed with compressed air through the pipe 1b and the pneumatic turbine of the sprayer 20 by the pipe 32.

It will be appreciated that the fast discharge device is well adapted to a sprayer which has a rotating dispenser unit, which has a relatively high capacitance, by virtue of the dimensions of the parts raised to the high voltage and directly connected to the high-tension source.

Figure 4:
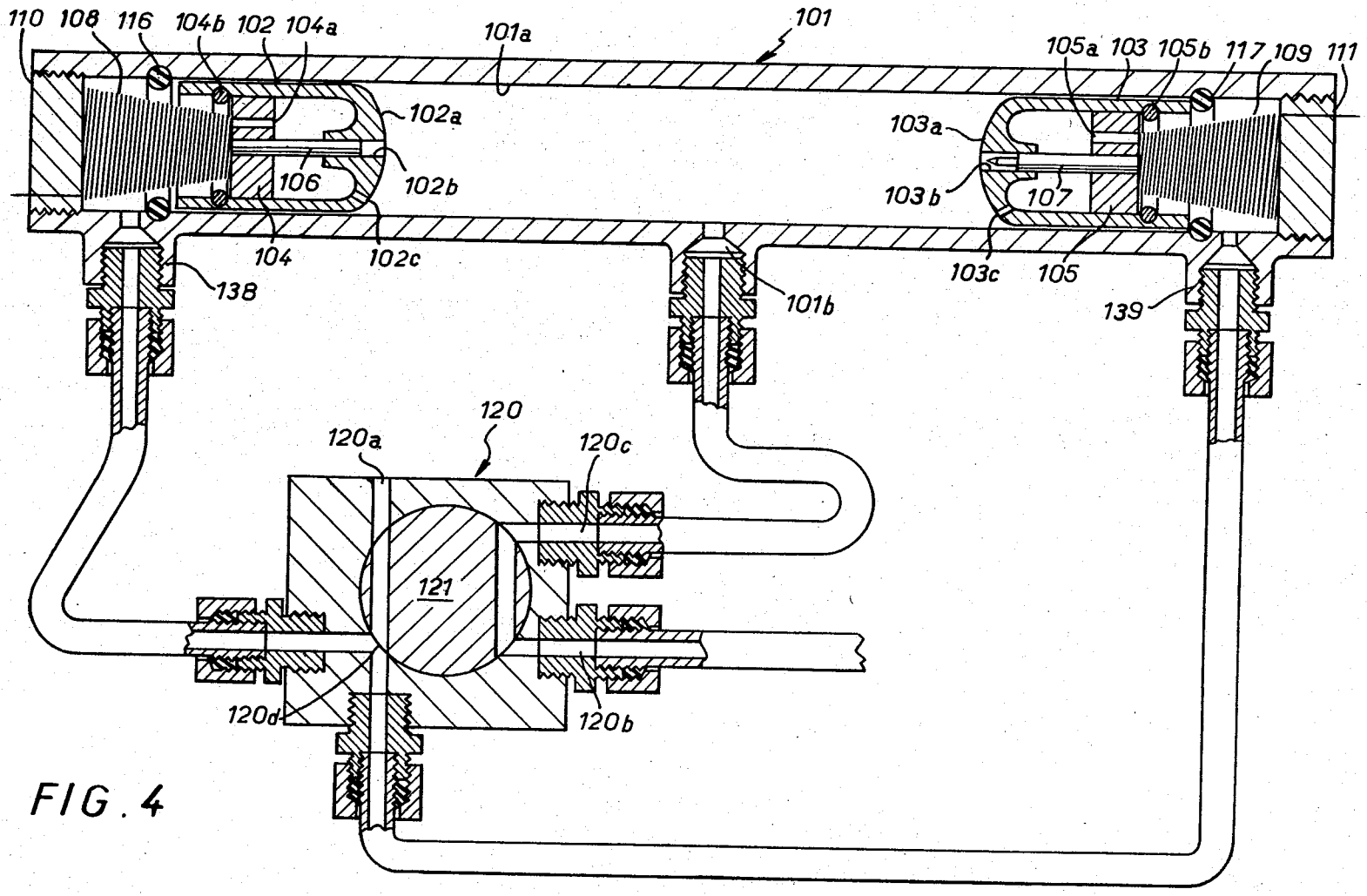
FIG. 4 shows an alternative embodiment in cross-section.

The alternative embodiment shown in FIG. 4 uses air pressure to propel the electrodes towards one another as well as to move them apart. Within the cylinder 101 there is disposed two electrode pistons 102, 103 featuring part-spherical domes 102a, 103a. In this case the domes 102a, 103a merge directly with the lateral wall of the pistons 102, 103, which facilitates machining them but has the disadvantage that the device is more sensitive to the risk of discharge which creep along the internal wall of the cylinder. On the axes of the domes 102a, 103a there are formed holes 102b, 103b for deployable needles 106, 107 mounted on auxiliary pistons 104, 105. Note that the auxiliary pistons 104, 105 are formed with vents 104a, 105a and the pistons 102, 103 are formed with vents 102c and 103c.

Rings 104b, 105b limit rearward displacement of the auxiliary pistons 104, 105 while rings 116, 117 limit displacement of the electrode pistons 102, 103. The cylinder end members 110, 111 do not comprise any vents.

Note that the needles 106, 107 have their ends shaped like the needles 6,7 as shown in FIG. 5. Also, the auxiliary pistons 104, 105 are linked by flexible connections 108, 109 to lead-through terminals in the end members 110, 111 for connection to the terminals of the source to be discharged.

A pressurized gas pipe 101b communicates with the median area of the cylinder 101 and two pipes 138, 139 terminate in the vicinity of the end members 110, 111, respectively.

A four-way changeover valve 120 controls the device. One path 120*a* leads to atmosphere, one path 120*b* is connected to a compressed air supply, one path 120*c* is connected to the pipe 101*b* and path 120*d* feeds both pipes 138 and 139. In the position shown, a rotating plug connects the path 120*c* to the path 120*b* and the path 120*d* to the path 120*a*. On rotation through one quarter-turn, the plug 121 would connect path 120*c* to path 120*a* and path 120*d* to path 120*b*.

The configuration shown corresponds to the ready condition, with the high-tension source in service. The compressed air is fed to the median area between the pistons 102 and 103, which are held against the abutment rings 116, 117. When the high-tension electrode must be discharged, the plug 121 is rotated through a quarter-turn. Pressure is then applied to the rear of the piston combinations 102, 104 and 103, 105. These are pushed forward and deploy the needles 106, 107 and the pistons 102 and 103 are pushed towards one another. The needles 106, 107 come into contact with one another.

When the plug 121 is again rotated through a quarter-turn to reestablish the high-tension supply at a subsequent time, venting to atmosphere the pipes 108 and 109 and pressurizing the pipe 101*b*, the chambers between the electrode pistons 102, 103 and auxiliary pistons 104, 105 will be pressurized relative to the ends of the cylinder 101 and the auxiliary pistons 104, 105 will be pushed against the abutment rings 104*b*, 105*b* while the pistons 102, 103 are pushed back towards the cylinder end members 110, 111 by the pressure in the median part of the cylinder.

It will be understood that it is possible to provide an annular groove in the inside surface of the cylinder 1 at the outlet from the pipe 101*b*, so as to cut the leakage lines on this inside surface. Also, it need hardly be stated for the benefit of those skilled in the art that the layout and the nature of the pipes 101*b*, 108 and 109 must be designed to provide high-tension leakage lines so as to avoid uncontrolled current losses; for making the cylinder use might be made of an insulative material with a resistivity lower than that of the best known insulators, in order to avoid surface areas charging eratically and giving rise to microdischarges at the surface as a preliminary to generalized discharges.

It will be understood that various changes in the details, materials and arrangements of parts which have been herein described and illustrated in order to explain the nature of the invention may be made by those skilled in the art within the principle and scope of the invention as expressed in the appended claims.

For example, one of the electrode pistons 2, 102 or 3, 103 could be replaced by a fixed dome-shaped electrode, for preference equipped with a deployable needle. It will be obvious that if one electrode is fixed, the outlet from the central passage 1*b*, 101*b* would be situated near the fixed electrode.

It is claimed;

1. Device for rapidly discharging without arcing a high-tension DC voltage source which has a very high capacitance when coupled to the impedance of a load circuit, comprising two dome-shaped electrodes adapted to be connected to respective poles of said source, trigger means adapted to move said electrodes towards one another along a predetermined path on which the domes are centered and until they come into contact with one another, a deployable needle on at least one of said electrodes adapted to be deployed beyond the boundary of the aforementioned dome shape thereof in the direction of movement of said at least one electrode when said electrodes are moved towards one another, and means for containing an insulative gas around said electrodes, whereby a discharge from said needle or needles into said gas removes a substantial proportion of the electrical charge stored in the aforementioned capacitance before the aforementioned contact takes place.

2. Device according to claim 1, wherein each of said electrodes comprises a respective deployable needle and is constituted by a piston, said device further comprising a common insulative cylinder in which each of said electrode pistons is adapted to slide and a pipe which is adapted to be selectively connected to a supply of pressurized gas or vented to atmosphere by said trigger means and which communicates with said cylinder in its median part, between said electrode pistons, whereby said electrode pistons are held apart and said needles are retracted against return means by gas pressure when said pipe is connected to said pressurized gas supply.

3. Device according to claim 2, wherein said electrode pistons comprise internal auxiliary pistons attached to said needles and on which said return means act, and wherein vents are provided in said electrode pistons and said auxiliary pistons to provide for adjustment of the pressure between said electrode pistons and auxiliary pistons and the relative displacements thereof.

4. Device according to claim 3, wherein said return means comprise metal springs disposed in compression between said auxiliary pistons and respective ends of said cylinder, each of which ends is formed with a vent, and further comprising respective connections passing through said ends of said cylinder and adapted to connect said springs to respective poles of said source.

5. Device according to claim 3, wherein said cylinder is equipped with respective pipes which communicate with its end parts and said triggering device is adapted, in a standby condition, to connect said pipe communicating with said median part to said pressurized gas supply and to vent said pipes communicating with said end parts to atmosphere and, in a triggered condition, to connect said pipes communicating with said end parts to said pressurized gas supply and to vent said pipe communicating with said median part to atmosphere.

6. Device according to claim 2, wherein said domes of said electrodes are of smaller diameter than said cylinder and merge with the remainder of said pistons via a rounded shoulder.

7. Device according to claim 2, wherein said needles have ends of complementary shape, one having a point and the other a sharp-edged conical recess.

8. Device according to claim 2, further comprising an annular groove in the inside surface of said cylinder at the point of entry of said pipe communicating with said median part thereof.

* * * * *